US008141983B2

(12) United States Patent
Fujii

(10) Patent No.: US 8,141,983 B2
(45) Date of Patent: Mar. 27, 2012

(54) LIQUID JET HEAD AND IMAGE FORMING APPARATUS

(75) Inventor: Kaori Fujii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 718 days.

(21) Appl. No.: 12/294,559

(22) PCT Filed: Feb. 4, 2008

(86) PCT No.: PCT/JP2008/052204

§ 371 (c)(1),
(2), (4) Date: Sep. 25, 2008

(87) PCT Pub. No.: WO2008/096883

PCT Pub. Date: Aug. 14, 2008

(65) Prior Publication Data

US 2009/0058940 A1 Mar. 5, 2009

(30) Foreign Application Priority Data

Feb. 9, 2007 (JP) ..... 2007-031146
Oct. 27, 2007 (JP) ..... 2007-279722

(51) Int. Cl.
*B41J 2/14* (2006.01)
*B41J 2/045* (2006.01)

(52) U.S. Cl. ..... 347/47; 347/70

(58) Field of Classification Search ..... 347/47, 347/68–72; 29/890.1
See application file for complete search history.

(56) References Cited

U.S. PATENT DOCUMENTS

| | | | |
|---|---|---|---|
| 4,972,204 | A | 11/1990 | Sexton |
| 6,402,921 | B1 | 6/2002 | Ahn et al. |
| 2003/0143492 | A1 | 7/2003 | Sexton |
| 2004/0105996 | A1 | 6/2004 | Takagi et al. |
| 2004/0174411 | A1 | 9/2004 | Sumiya et al. |
| 2006/0127814 | A1 | 6/2006 | Sexton |

FOREIGN PATENT DOCUMENTS

| | | | |
|---|---|---|---|
| EP | 0999058 | A2 | 5/2000 |
| EP | 1332879 | A1 | 8/2003 |
| JP | 3-286870 | | 12/1991 |
| JP | 5-4346 | | 1/1993 |
| JP | 8-142334 | | 6/1996 |
| JP | 9-300635 | | 11/1997 |
| JP | 10-16215 | | 1/1998 |
| JP | 11-179908 | | 7/1999 |
| JP | 2000-218792 | | 8/2000 |

*Primary Examiner* — Geoffrey Mruk
(74) *Attorney, Agent, or Firm* — Cooper & Dunham LLP

(57) ABSTRACT

A liquid jet head includes a nozzle member having plural nozzles for jetting a liquid therefrom, a flow path member forming at least a part of a liquid chamber communicating with each of the plural nozzles, and a pressure generating part for generating pressure that is applied to the liquid inside the liquid chamber. The nozzle member and the flow path member are each formed by a metal material. The metal material of the nozzle member has substantially the same composition as the metal material of the flow path member. The metal material of the nozzle member includes crystal particles having an average particle diameter which is less than that of the crystal particles included in the metal material of the flow path member.

11 Claims, 6 Drawing Sheets

LIQUID JET HEAD AND IMAGE FORMING APPARATUS

TECHNICAL FIELD

The present invention relates to a liquid jet head and an image forming apparatus.

BACKGROUND ART

Image forming apparatuses such as printers, facsimiles, copiers, and multi-function machines having the functions of a printer, a facsimile, and a copier, form images by conveying a medium (hereinafter also referred to as "paper") and jetting a liquid (hereinafter also referred to as "recording liquid" or "ink") onto the medium. In forming the images, the image forming apparatus uses, for example, a liquid jet apparatus including a recording head having a liquid jet head for jetting droplets of liquid (recording liquid). It is to be noted that image forming may also be referred to as recording, printing, image printing, or character printing. It is also to be noted that the material of the medium is not limited to a particular material. Thus, the medium may be also be referred to as a target recording medium, a recording medium, transfer material, or a recording paper.

The image forming may be performed on a medium made of, for example, paper, thread, fiber, cloth, leather, metal, plastic, glass, wood, or ceramic. Furthermore, the image forming not only includes forming images which have meaning (e.g., characters, shapes) but also includes forming images having no particular meaning (e.g., patterns). Furthermore, as long as images can be formed, the liquid is not limited to a recording liquid or ink. The liquid jet apparatus refers to an apparatus that jets liquid by using a liquid jet head.

One example of the liquid jet head used in the above-described liquid jet apparatus of the image forming apparatus is disclosed in Japanese Laid-Open Patent Application No. 3-286870 (hereinafter referred to as "Patent Document 1"). The liquid jet head disclosed in Patent Document 1 has a nozzle member and a flow path member that are bonded together as different members by using a thermal diffusion method.

Japanese Laid-Open Patent Application Nos. 10-16215, 2000-218792, and 11-179908 (hereinafter referred to as "Patent Document 2", "Patent Document 3", and "Patent Document 4", respectively) disclose a liquid jet head having a nozzle member and a flow path member integrally formed by using an electroforming method (electrocrystallization).

As another example of the liquid jet head, Japanese Laid-Open Patent Application No. 9-300635 (hereinafter referred to as "Patent Document 5") discloses a liquid jet head using a method of forming a vibration plate (diaphragm) by Ni electroforming and fabricating the crystal lattice planes (111) and (100) of an Ni crystalline member to satisfy a relationship (111)≧(100). As another of the liquid jet heads, Japanese Laid-Open Patent Application No. 8-142334 (hereinafter referred to as "Patent Document 6") discloses a liquid jet head using a method of forming a nozzle member by Ni electroforming.

However, in a case of bonding together different members (i.e. nozzle member and flow path member) such as in Patent Document 1, the thinness of the nozzle member causes difficulty in handling and makes the nozzle member susceptible to deformation by electrocrystallization stress. Thus, it is difficult to bond large areas together. Furthermore, the processes of positioning and diffusion bonding are complicated. Inaccurate positioning between a nozzle and a liquid chamber leads to problems such as an undesired liquid jetting direction (e.g., liquid droplet deviating from target).

Particularly, under the circumstance where there is a growing demand for a liquid jet head capable of forming dots (dpi, dots per inch) with high density, it is becoming more difficult to perform bonding by using an adhesive agent. That is, it is almost impossible to steadily apply an adhesive agent in the bonding process. Even if an adhesive agent can be applied, it is difficult to achieve sufficient bonding strength.

The method of integrally forming the nozzle member and the flow path member by electroforming (such as in Patent Document 2) can resolve the difficulty of bonding the nozzle member and the flow path member. However, this method does not take into consideration, for example, rigidity or strength of the members, processing time of the members, or surface characteristics of the members related to liquid fluidity (flow characteristics).

For example, in order to reduce the fluid resistance (flow resistance) of the nozzle member, it is suitable to form the inlet of the nozzle member into a round shape. Furthermore, fine protrusions or recesses or foreign matter formed on the inner wall of the nozzle member cause inconsistency (fluctuation) in the formation of a meniscus. This leads to deviation of the liquid jetting direction. Furthermore, the nozzle member is required to have sufficient rigidity against external force for preventing deformation (e.g., vibration or deformation by pressure during liquid jetting or by contact with a medium). Moreover, the flow path member is required to have sufficient rigidity for enduring liquid pressure for efficiently changing the pressure in a liquid chamber.

However, since the method of integrally forming the nozzle member and the flow path member does not consider rigidity or strength of the members, processing time of the members, or surface characteristics of the members related to liquid fluidity (flow characteristics), the method is unable to provide sufficiently stable liquid jetting efficiency and liquid jetting performance.

In addition, there is also a method of integrally forming a flow path member and a fluid resistance member having a fluid resistance part provided between a liquid chamber and a common flow path for supplying liquid to each liquid chamber (the fluid resistance part having greater fluid resistance than the liquid chamber), a method of integrally forming a flow path member and a filter member having a filter part extending from a common flow path to a liquid chamber for catching foreign matter, or a method of integrally forming a flow path member and a vibration plate member. Nevertheless, in the case of integrally forming the flow path member and a thin member (material that is thinner than the flow path member such as the nozzle member, the fluid resistance member, the filter member, the vibration plate member), it is difficult to attain sufficient rigidity for the thin member.

BRIEF SUMMARY

In an aspect of this disclosure, there is provided a liquid jet head including a nozzle member having a plurality of nozzles for jetting a liquid therefrom, a flow path member forming at least a part of a liquid chamber communicating with each of the plural nozzles, and a pressure generating part for generating pressure that is applied to the liquid inside the liquid chamber, wherein the nozzle member and the flow path member are each formed by a metal material, wherein the metal material of the nozzle member has substantially the same composition as the metal material of the flow path member, wherein the metal material of the nozzle member includes crystal particles having an average particle diameter which is less than that of the crystal particles included in the metal material of the flow path member.

In another aspect, there is provided a liquid jet head including a nozzle member having a plurality of nozzles for jetting a liquid therefrom, a flow path member forming at least a part of a plurality of liquid chambers communicating to each of the plural nozzles, a common flow path for supplying the liquid to each of the liquid chambers, a fluid resistance member forming a plurality of fluid resistance parts between the common flow path and each liquid chamber, and a pressure generating part for generating pressure that is applied to the liquid inside the liquid chamber, wherein the fluid resistance member and the flow path member are each formed by a metal material, wherein the metal material of the fluid resistance member has substantially the same composition as the metal material of the flow path member, wherein the metal material of the fluid resistance member includes crystal particles having an average particle diameter which is less than that of the crystal particles included in the metal material of the flow path member.

In another aspect, there is provided a liquid jet head including a liquid chamber communicating to a plurality of nozzles for jetting a liquid therefrom, a flow path member forming at least a part of the liquid chamber, a pressure generating part for generating pressure that is applied to the liquid inside the liquid chamber, and a thin layer member integrally formed with the flow path member, wherein the thin layer member is thinner than the flow path member, wherein the thin layer member and the flow path member are each formed by a metal material, wherein the metal material of the thin layer member has substantially the same composition as the metal material of the flow path member, wherein the metal material of the thin layer member includes crystal particles having an average particle diameter which is less than that of the crystal particles included in the metal material of the flow path member.

In another aspect, there is provided an image forming apparatus including the aforementioned liquid jet head.

BEST MODE FOR CARRYING OUT THE INVENTION

Figure 1:
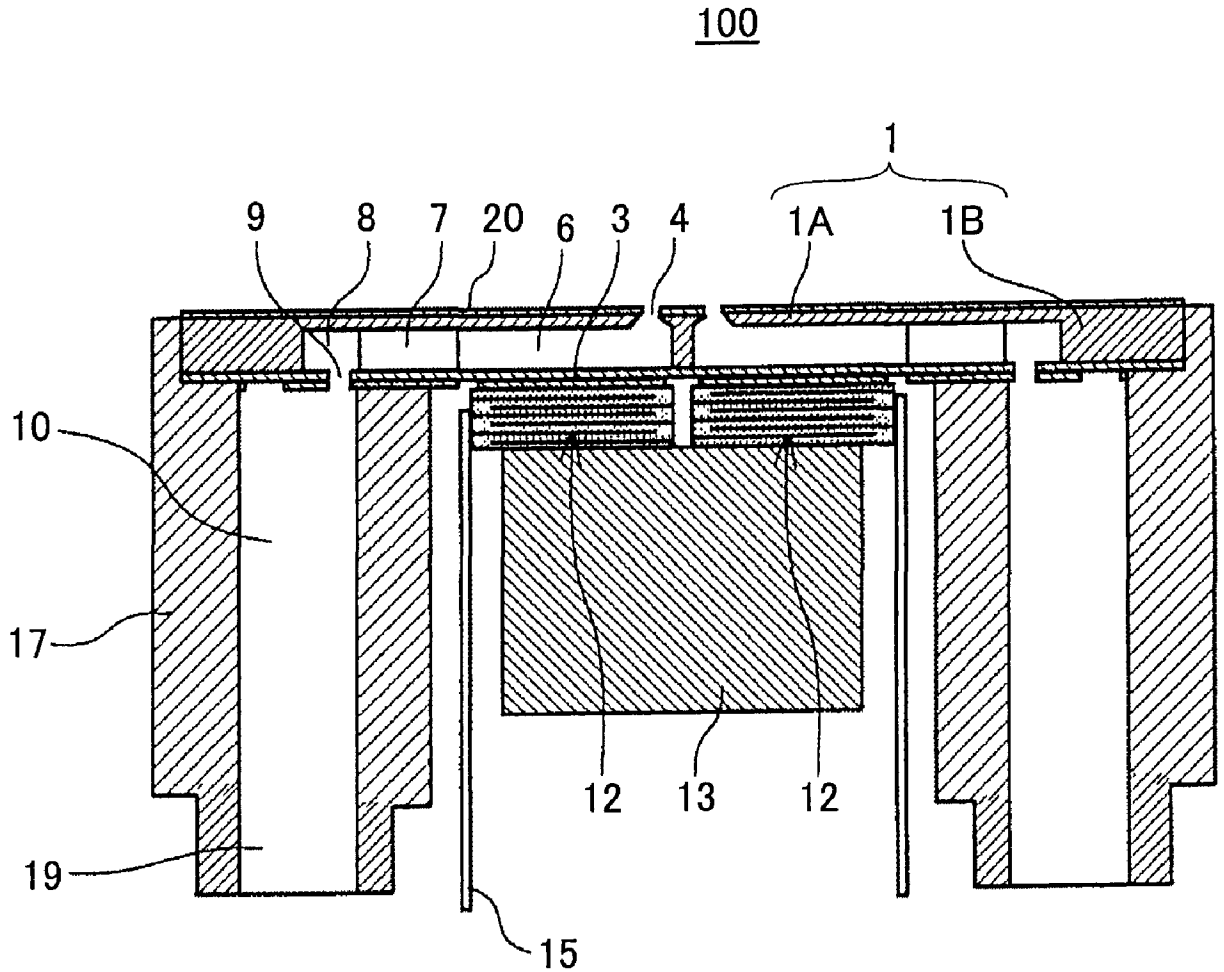
FIG. 1 is a cross-sectional view of a liquid jet head with respect to a longitudinal direction of a liquid chamber according to an embodiment of the present invention.

The present invention is described in detail based on the embodiments illustrated in the drawings.

A liquid jet head 100 according to a first embodiment of the present invention is described with reference to FIG. 1. FIG. 1 is a cross-sectional view of a liquid jet head with respect to a longitudinal direction of a liquid chamber according to an embodiment of the present invention.

The liquid jet head 100 includes a nozzle/flow path plate 1 and a vibration plate 3. The nozzle/flow path plate 1 has a nozzle member portion 1A and a flow path member portion 1B that are integrally formed. The vibration plate 3 is bonded to a bottom surface of the nozzle/flow path plate 1. The nozzle/flow path plate 1 and the vibration plate 3 form a liquid chamber 6 communicating with a nozzle 4 that jets liquid droplets, a fluid resistance part 7, and a communicating part 8 for communicating with the liquid chamber 6 via the fluid resistance part 7. Accordingly, recording liquid (e.g., ink) can be supplied from a common liquid chamber 10 formed in a frame member 17 (described below) to the communicating part 8 via a supply port 9 formed in the vibration plate 3.

Furthermore, the top surface of a layered type piezoelectric element 12 is joined to an outer side (opposite side of the liquid chamber 6) of the vibration plate 3 in correspondence with each liquid chamber 6. In this example, the piezoelectric element 12 is joined to the vibration plate 3 via a coupling part (not shown) formed in the vibration plate 3. The piezoelectric element 12 acts as an actuator part or a pressure generating part. Meanwhile, the bottom surface of the piezoelectric element 12 is joined to a base member 13. The piezoelectric element 12 and the base member 13 form a piezoelectric type actuator.

The piezoelectric element 12 according to an embodiment of the present invention has plural piezoelectric material layers and internal electrodes that are alternately layered one on top of the other. The internal electrodes are drawn out to an end face of the piezoelectric element and connected to an end face electrode (external electrode) provided at the end face of the piezoelectric element 12. Accordingly, displacement occurs in the layered direction by applying voltage to the end face electrode. An FPC cable 15 is connected (joined) to the end face electrode of the piezoelectric element 12 by, for example, a soldering method, an ACF (anisotropic conductive film) bonding method, or a wire bonding method. The FPC cable 15 has a driving circuit mounted (driver IC, not shown) for selectively applying drive waveforms.

The liquid jet head 100 is configured to apply pressure to the recording liquid inside the liquid chamber 6 by using the displacement in a d33 direction (piezoelectric direction of the piezoelectric element 12). Furthermore, the liquid jet head 100 is configured to jet droplets of recording liquid by using a side shooter method. The side shooter method jets the recording liquid in a direction orthogonal to the flowing direction of the recording liquid. By using the side shooter method, the piezoelectric element 12 can be formed in a size substantially the same as the liquid jet head 100. Accordingly, since size reduction of the piezoelectric element 12 can directly lead to size reduction of the liquid jet head 100, size reduction of the liquid jet head 100 can be easily achieved.

The frame member 17 is bonded to the outer area of the piezoelectric actuator portion of the liquid jet head 100 including the piezoelectric element 12, the base member 13, and the FPC 15. The frame member 17 is bonded by an injection molding method using an epoxy type resin or polyphenylene sulfide. The frame member 17 includes the common liquid chamber 10 and the supplying port 19 for supplying recording liquid from outside the liquid jet head 100 to the common liquid chamber 10. The supplying port 19 is connected to a recording liquid supplying source (not shown) such as a sub-tank or a recording liquid cartridge (ink cartridge).

The nozzle/flow path plate 1 has the nozzle member portion 1A and the flow path member portion 1B integrally formed by nickel (Ni) electroforming. One nozzle 4 is formed in the nozzle member portion 1A of the nozzle/flow path plate 1 in correspondence with each liquid chamber 6. The nozzle 4 has a diameter of, for example, 10 to 35 μm. A water-repellent layer 20 is formed on a liquid jetting side (surface toward the liquid jetting direction: jetting surface or surface opposite of the liquid chamber 6).

The vibration plate 3 is formed of a metal plate. In this example, the vibration plate 3 is formed of nickel (Ni). The vibration plate 3 is manufactured by an electroforming method. The vibration plate 3 has a thin portion corresponding to the liquid chamber 6 for enabling easy deformation. Furthermore, the vibration plate 3 also has a coupling portion provided at its center for bonding to the piezoelectric element 12.

For example, the liquid jet head 100 having the above-described configuration may be driven by a pushing method. With this pushing method, a control part (not shown) allows drive pulse voltages ranging from 20 to 50 V to be selectively applied to plural piezoelectric elements 12 in accordance with an image to be recorded. The application of the drive pulse voltages causes displacement (movement) of the piezoelectric elements 12 so that the vibration plate 3 is deformed toward the direction of the nozzle member portion 1A. The deformation of the vibration plate 3 changes the capacity (volume) of the liquid chamber 6 and pressurizes the liquid in the liquid chamber 6. Thereby, droplets of liquid are jetted from the nozzle 4 of the nozzle member portion 1A. As the pressure inside the liquid chamber 6 decreases after jetting the liquid, the inertia created by the flow of liquid inside the liquid chamber 6 generates a slight negative pressure in the liquid chamber 6. In this case, the vibration plate 3 returns to its initial position and the liquid chamber 6 returns to its original shape by switching off the application of voltage to the piezoelectric element 12, to thereby further generate negative pressure in the liquid chamber 6. At this stage, recording liquid is supplied from the common liquid chamber 10 to the liquid chamber 6 so that liquid droplets can be jetted from the nozzle 4 in response to the next application of drive pulses to the piezoelectric element 2.

The liquid jet head 100 may alternatively use other driving methods besides the pushing method. For example, the liquid jet head 100 may use a pulling method where pressure is applied by releasing the vibration plate 3 from a pulled position and utilizing the recovering force or a push-pull method where pressure is applied by maintaining the vibration plate 3 at a neutral position, pulling the vibration plate 3 from the neutral position, and pushing the vibration plate 3 from the pulled position.

Next, the nozzle/flow path plate 1, along with its manufacturing steps, is described in detail with reference to FIG. 2.

Figure 2:
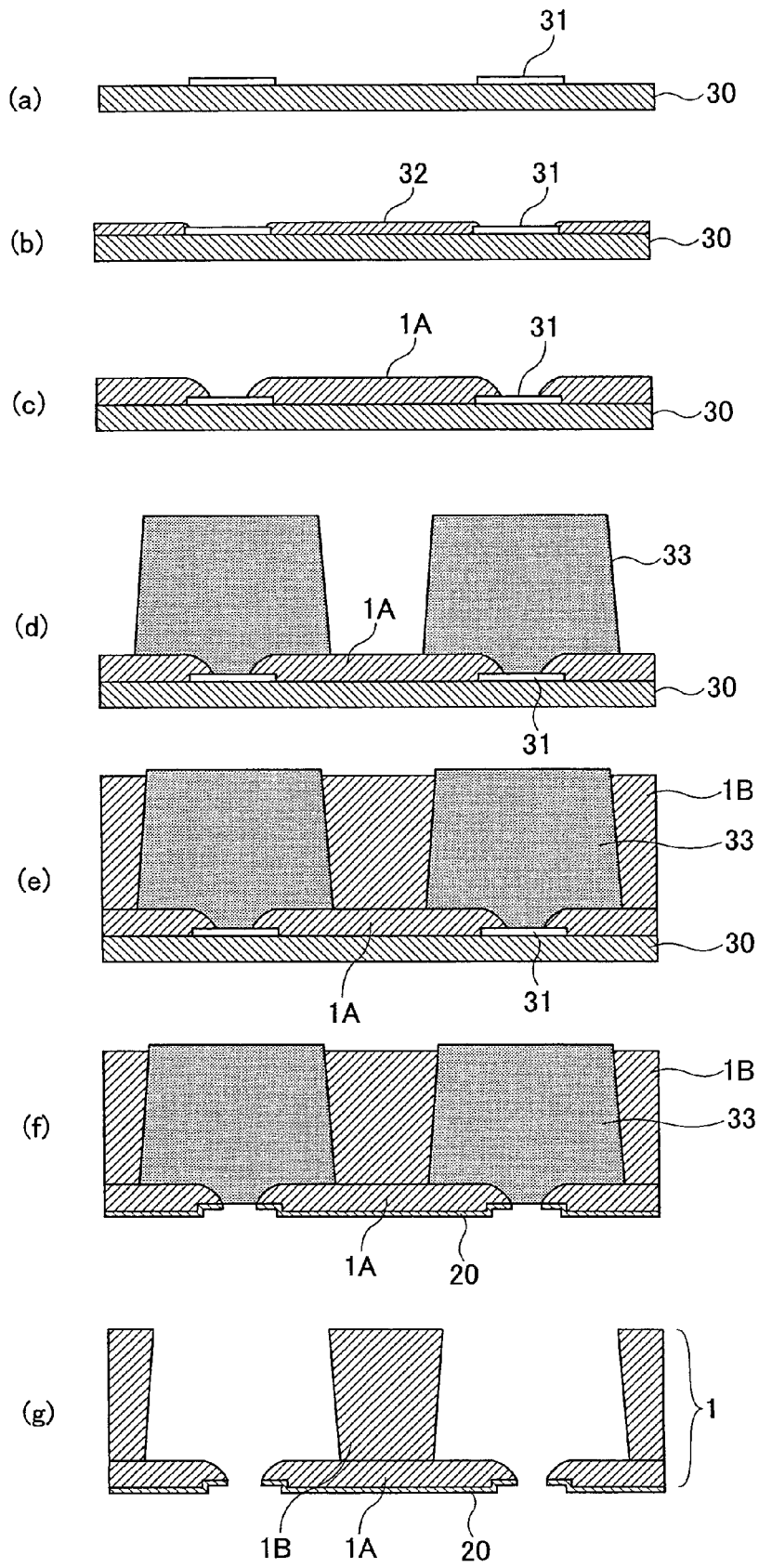
FIG. 2 are cross-sectional views for describing manufacturing steps of a nozzle/flow path member of the liquid jet head shown in FIG. 1 according to an embodiment of the present invention.
Figure 3:
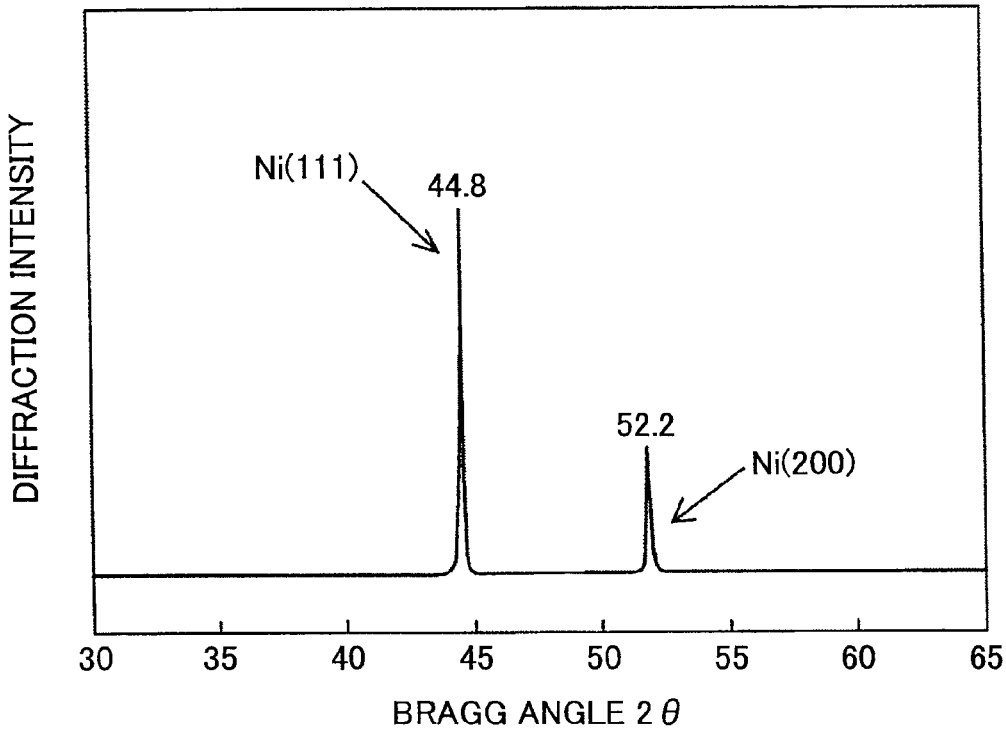
FIG. 3 is a schematic diagram showing X-ray diffraction spectral results of a nozzle member part of the nozzle/flow path member of the liquid jet head shown in FIG. 1 according to an embodiment of the present invention.
Figure 4:
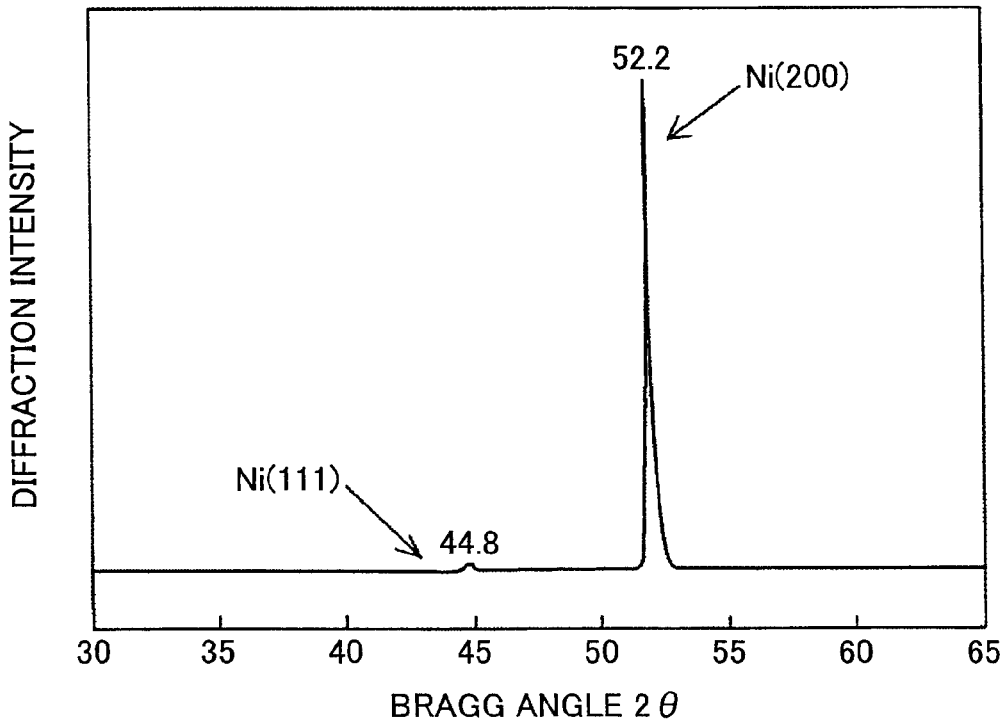
FIG. 4 is a schematic diagram showing X-ray diffraction spectral results of a flow path member part of the nozzle/flow path member of the liquid jet head shown in FIG. 1 according to an embodiment of the present invention.

As shown in FIG. 2(*a*), resist patterns 31 are formed on an electroform support substrate 30 in correspondence with the position where the nozzles 4 are to be formed. As shown in FIG. 2(*b*), an electroformed film 32 corresponding to the nozzle member portion 1A is deposited by using, for example, a Ni electroforming method. As shown in FIG. 2(*c*), the electroforming process is stopped when the electroformed film 32 reaches the thickness of the nozzle member portion 1A. A part of the nozzle member portion 1A extending from a liquid (recording liquid) inlet to a liquid (recording liquid) jetting side is formed in a substantially round shape. By forming such part into a round shape, the fluid resistance during liquid jetting can be reduced.

As shown in FIG. 2(*d*), resist patterns 33 are formed in a shape corresponding to the shape of the liquid chamber 6. Then, as shown in FIG. 2(*e*), an electroformed film corresponding to the flow path member 1B is deposited by using the Ni electroforming method. The electroforming process is completed when the other electroformed film reaches the thickness of the flow path member 1B.

Then, as shown in FIG. 2(*f*), the electroformed film (nozzle member portion 1A and flow path member portion 1B) is separated from the electroform support substrate 30, and the resist patterns 31 are removed. Then, a water-repellent film (water-repellent layer) 20 is formed on the surface of the nozzle member portion 1A. Then, as shown in FIG. 2(*g*), the nozzle/flow path member 1 can be obtained by removing the resist patterns 33.

Although the nozzle/flow path member 1 is formed as a single united body (integral body) comprising the nozzle member portion 1A and the flow path member portion 1B according to an embodiment of the present invention, the material structure (texture) and manufacturing conditions of the nozzle member portion 1A and the flow path member portion 1B are different in view of their functions and characteristics.

That is, although it is preferable to form the nozzle member portion 1A as thin as possible for reducing fluid resistance during liquid jetting, it is also desired for the nozzle member portion 1A to have high rigidity for preventing deformation from external force (e.g., vibration of the nozzle member portion 1A caused by pressure generated during liquid jetting, or contact with the recording medium). Meanwhile, the flow path member portion 1B has high rigidity due to its thickness which is two times or more that of the nozzle member portion 1A. However, a significant amount of time may be required for performing the electrodeposition (electrocrystallization) process on the flow path member portion 1B due to its thickness. This may lead to an increase of manufacturing cost.

Therefore, although the nozzle member portion 1A and the flow path member portion 1B according to an embodiment of the present invention are integrally formed by Ni electroforming, the crystal particles of the electroformed film (metal material) forming the nozzle member portion (i.e. thin layer member) 1A have an average particle diameter which is smaller than that of the crystal particles of the electroformed film (metal material) forming the flow path member portion 1B.

More specifically, in the step of fabricating the nozzle member portion 1A, the electroforming process is performed in a low electric current density condition, so that a brightener (brightening agent) in an electrolytic liquid can be easily incorporated into the electroformed film (deposited film). Thereby, the average particle diameter of the crystal particles of the electroformed film (nozzle member portion 1A) can be small (fine). Thus, the nozzle member portion 1A can be formed to be a very hard member. Meanwhile, in the step of fabricating the flow path member portion 1B, the brightener in the electrolytic liquid is prevented from being incorporated by performing the electroforming process in a high electric current density condition. Accordingly, the average particle diameter of the crystal particles of the electroformed film (flow path member portion 1B) can be increased. Thus, the electroforming time (deposition time) of the flow path member portion 1B can be shortened. Thus, deposition of the flow path member portion 1B can be efficiently performed.

In the electroforming process of the flow path member portion 1B, it is preferable that the material textural change from the nozzle member portion 1A to the flow path member portion 1B be gradual, so as to attain a sufficient adhesiveness (bond) between the nozzle member portion 1A and the flow path member portion 1B. Therefore, the deposition of the flow path member portion 1B is performed with the same electroforming condition (low current density condition) as that of the deposition of the nozzle member portion 1A on a part of the flow path member portion 1B situated approximately 0.1 μm to 5 μm from the interface with the nozzle member portion 1A in its thickness direction. Thereby, such part of the flow path member portion 1B can attain a particle diameter similar to that of the nozzle member portion 1A.

Alternatively, in the electroforming of the flow path member portion 1B, the electroforming condition may be gradually modified at the part of the flow path member portion 1B situated approximately 0.1 μm to 5 μm from the interface with the nozzle member portion 1A in its thickness direction, so that the average particle diameter of the crystal particles of the flow path member portion 1B is substantially the same as that of the nozzle member portion 1A at the interface with the nozzle member portion 1A and gradually increases the farther away are the particles from the interface with the nozzle member portion 1A. Accordingly, the average particle diameter of the crystal particles increases progressively or step-by-step.

With the above-described flow path member portion 1B having a configuration where the interface part with respect to the nozzle member portion 1A has crystal particles having an average particle diameter which is substantially the same as that of the crystal particles of the nozzle member portion 1A or a configuration where a part toward the interface with the nozzle member portion 1A has crystal particles having an average particle diameter that progressively (gradually) increases the farther away are the particles from the interface with the nozzle member portion 1A, the adhesiveness (bond) between the nozzle member portion 1A and the flow path member portion 1B can be improved even where the nozzle member portion 1A and the flow path member portion 1B are integrally formed while having crystal particles of different particle diameters.

In a case where nickel is used in the above-described metal electroforming method, the X-ray diffraction spectrum of the nozzle/flow path member 1 exhibits diffraction peaks at the points where the Bragg angles 2θ are "44.8°±0.2°" and "52.2°±0.2°". The crystal structure of the nickel is a body-centered cubic lattice where the (111) plane is a slip plane. In order to obtain a dense (fine) crystal particle structure, growth of the (111) plane is effective. On the other hand, growth of the (200) plane is effective in a case of prioritizing deposition efficiency of nickel and reducing incorporation of brightener.

Accordingly, in a case of fabricating the nozzle member portion 1A to have a relatively dense (fine) crystal particle structure and fabricating the flow path member portion 1B to have a relatively large crystal particle average diameter, it is preferable that the peak intensity ratio between the nozzle member portion 1A part and the flow path member 1B part satisfy a relationship of "$I_a(111)/I_a(200) < I_b(111)/I_a(200)$", wherein "$I_a(111)$" indicates the diffraction peak intensity of the (111) plane on the part of the nozzle member portion 1A;

"$I_a(200)$" indicates the diffraction peak intensity of the (200) plane on the part of the nozzle member portion 1A;

"$I_b(111)$" indicates the diffraction peak intensity of the (111) plane on the part of the flow path member portion 1B; and "$I_b(200)$" indicates the diffraction peak intensity of the (200) plane on the part of the flow path member portion 1B.

Although the control of the average particle diameter in the above-described embodiment of the present invention is performed by changing the electrodeposition speed (electrocrystallization speed), the control of the average particle diameter may also be performed by using other methods, such as a method of adding a trace of metal or a method of adding S, B, P, or C.

(1) Method of Adding a Trace of Metal

For example, a metal such as lead (Pb), manganese (Mn), thallium (Tl), or bismuth (Bi) of approximately 100 ppm is added to an electroforming liquid. Thus, with an electroformed film fabricated by adding such a trace of metal, the average particle diameter can be changed for each plating layer (electroformed film) since the growth of the average particle diameter can be restrained in a case of heating the electroformed film.

(2) Method of Adding S, B, P, C

For example, sulfur (S), boron (B), phosphorous (P), or carbon (C) of approximately 1 g/l is added to an electroforming liquid. Thereby, the average particle diameter of the electroformed film itself can be made into a fine size. Thus, the average particle diameter can be changed for each plating layer (electroformed film).

According to the above-described embodiment of the present invention, the water-repellent layer (water-repellent film) 20 is formed on the liquid jetting side of the nozzle/flow path member 1. The configuration of the nozzle/flow path member 1 having the nozzle member part 1A and the flow path member part 1B integrally formed as a united body facilitates the process of providing a water-repellent property, that is, forming the water-repellent layer 20. Furthermore, as shown in FIG. 2, since the water-repellent layer 20 can be formed while still maintaining the resist patterns 33 used for forming the flow path member portion 1B, a water-repellent agent, for example, can be prevented from penetrating (permeating) through the inner wall of the nozzle 4 or the wall of the liquid chamber 6. In this case, it is preferable for the resist material used in forming the resist patterns 31 used for forming the nozzle member portion 1A and the resist material used in forming the resist patterns 33 used for forming the flow path member portion 1B to have different characteristics (e.g., positive, negative) or different solubility. Alternatively, an insulating film may be uniformly provided on the electroform support substrate (substrate dedicated for electrodeposition) instead of the resist pattern 31 used for forming the nozzle member portion 1A.

The fabrication of the water-repellent layer 20 may be performed, for example, by a method of evaporating a water-repellent material in a vacuum environment or by a method of dissolving a water-repellent material in an appropriate solvent and coating the dissolved water-repellent material.

With the evaporating method, the water-repellent layer 20 may be formed on the nozzle surface (liquid jetting surface) according to the following steps. First, a vacuum chamber is prepared by exhausting the inside of the vacuum chamber until it reaches a predetermined vacuum degree. Then, a water-repellent material, vaporized at 400° C., is guided into the vacuum chamber. Then, an RF glow discharge is created by supplying electric power from a high frequency power source to a discharge electrode while adjusting the vacuum atmosphere. In the plasma discharge atmosphere, the nozzle surface (liquid jetting surface) of the liquid jet head 100 is surface-treated. It is to be noted that the water-repellent layer 20 may be formed at a low temperature ranging from approximately normal temperature to 200° C. depending on the material being used and the vacuum degree in the vacuum chamber.

As for the coating method, the water-repellent layer 20 may be formed on the nozzle surface (liquid jetting surface) by the following methods. In one exemplary coating method, a water-repellent material is dissolved in an organic solvent and coated onto the nozzle surface by using a jig (e.g., a wire-bar coating apparatus, a doctor blade). In another exemplary coating method, a spin coating apparatus (spin coater) may be used to rotatively coat the water-repellent material. In another exemplary coating method, a water-repellent material may be sprayed onto the nozzle surface. In yet another example, a dip-coating method may performed by using a container filled with coating liquid.

The water-repellent material may be, for example, an organic compound having fluorine atoms, and more particularly, an organic compound having fluoroalkyl group or an organic silicon compound having a dimethylsiloxane structure. The organic compound having fluorine atoms may preferably include, for example, fluoroalkylsilane, alkane having a fluoroalkyl group, carboxylic acid having a fluoroalkyl group, alcohol having a fluoroalkyl group, or amine having a fluoroalkyl group. More specifically, the fluoroalkylsilane may include, for example, heptadecafluoro-1,1,2,2-tetrahydrodecyltrimethoxysilane or heptadecafluoro-1,1,2,2-tetrahydrotrichlorosilane. The alkane having a fluoroalkyl group may include, for example, octofluorocyclobutane, perfluoromethylcyclohexane, perfluoro-n-heptane, tetradecafluoro-2-methylpenthane, perfluorododecane, or perfluorooctane acid. The carboxylic acid having a fluoroalkyl group may include, for example, perfluorodecane acid or perfluorooctane acid. The alcohol having a fluoroalkyl group may include, for example, 3,3,4,4,5,5,5-heptafluoro-2-pentanol. The amine having a fluoroalkyl group may include, for example, heptadecafluoro-1,1,2,2-tetrahydrodecylamine. The organic silicon compound having a dimethylsiloxane structure may include, for example, α,w-bis(3-glycidoxypropyl) polydimethylsiloxane, α,w-bis (vinyl) polydimethylsiloxane.

Alternatively, the water-repellent material may be, for example, an organic compound having a silicon atom, particularly, an organic compound having an alkylsiloxane group. The organic compound having an alkylsiloxane group may include, for example, an alkylsiloxane-containing epoxy resin having an alkylsiloxane group and two or more cycloaliphatic epoxy groups in the molecules of the alkylsiloxane-containing epoxy resin (compound). The alkylsiloxane-containing epoxy resin may include, for example, a polymer compound (A) containing structural units expressed by the following general formulas (a) and (b).

(A)

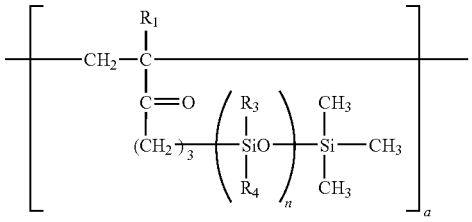

(a)

-continued

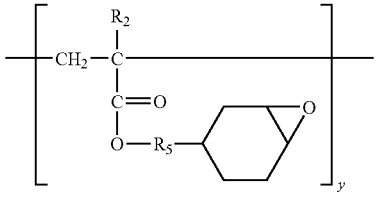

(b)

In the above-formulas:

x is an integer ranging from 1-50, y is an integer ranging from 2-100, and n is an integer ranging from 2-100

$R_1$ and $R_2$: —H or —$CH_3$, respectively.

$R_3$ and $R_4$: —$CH_3$ or

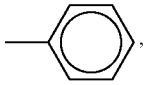

respectively.

$R_5$:

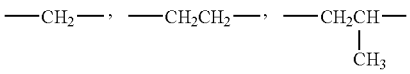

As explained in the above-described configuration according to an embodiment of the present invention, a nozzle member and a flow path member are integrally formed with a metal material having substantially the same composition where the average particle diameter of the crystal particles of the metal material forming the nozzle member is smaller than that of the crystal particles of the metal material forming the flow path member. With this configuration, the nozzle member and the flow path member can be integrally formed into a united body while attaining high rigidity for the nozzle member, thereby having a significant influence on liquid jetting efficiency and liquid jetting characteristics of the liquid jet head. Hence, liquid jetting efficiency can be improved and steady liquid jetting characteristics can be attained.

Although the nozzle member and the flow path member according to the above-described embodiment of the present invention are integrally formed by using a Ni electroforming method, the nozzle member and the flow path member may be integrally formed by a press-working method. Since the hardness of a metal material decreases as the average crystal diameter increases, fabrication is easy by using the press-working method, and the longevity of the metal mold used for the fabrication can be extended. Since strict precision is required for fabricating the nozzle member, it is preferable to form the crystal particles of the nozzle member in a fine size. That is, since fabrication of the nozzle (nozzle opening) by using the press-working method is similar to an act of stabbing with a thin needle, a needle would be deflected along a grain boundary when the needle happens to contact the grain boundary in a case where the crystal particles of the nozzle member have a large size. This may change the orientation (direction) of the press-working operation. Accordingly, in a case of fabricating the nozzle member and the flow path member by using a press-working method where the crystal particles of the nozzle member are formed with a lower average particle diameter than that of the crystal particles of the flow path member, the nozzle (nozzle opening) can be formed with high precision while attaining easier fabrication and longer metal mold longevity.

Alternatively, the nozzle member and the flow path member may be formed by an etching method. In the etching process, the etching rate is different for grain boundary etching and transgranular etching, and the grain boundary tends to bulge (protrude). In this case, when the average particle diameter of the etching target is small, more protrusions and recesses are formed on the surface and the surface area increases. These changes adversely affect corrosion resistance and liquid fluidity. Therefore, by forming the crystal particles of the nozzle member with a lower average particle diameter than that of the crystal particles of the flow path member in the case of forming the nozzle member and the flow path member by etching, the nozzle (nozzle opening) can be formed with high precision while preventing decrease of corrosion resistance and liquid fluidity.

Figure 5:
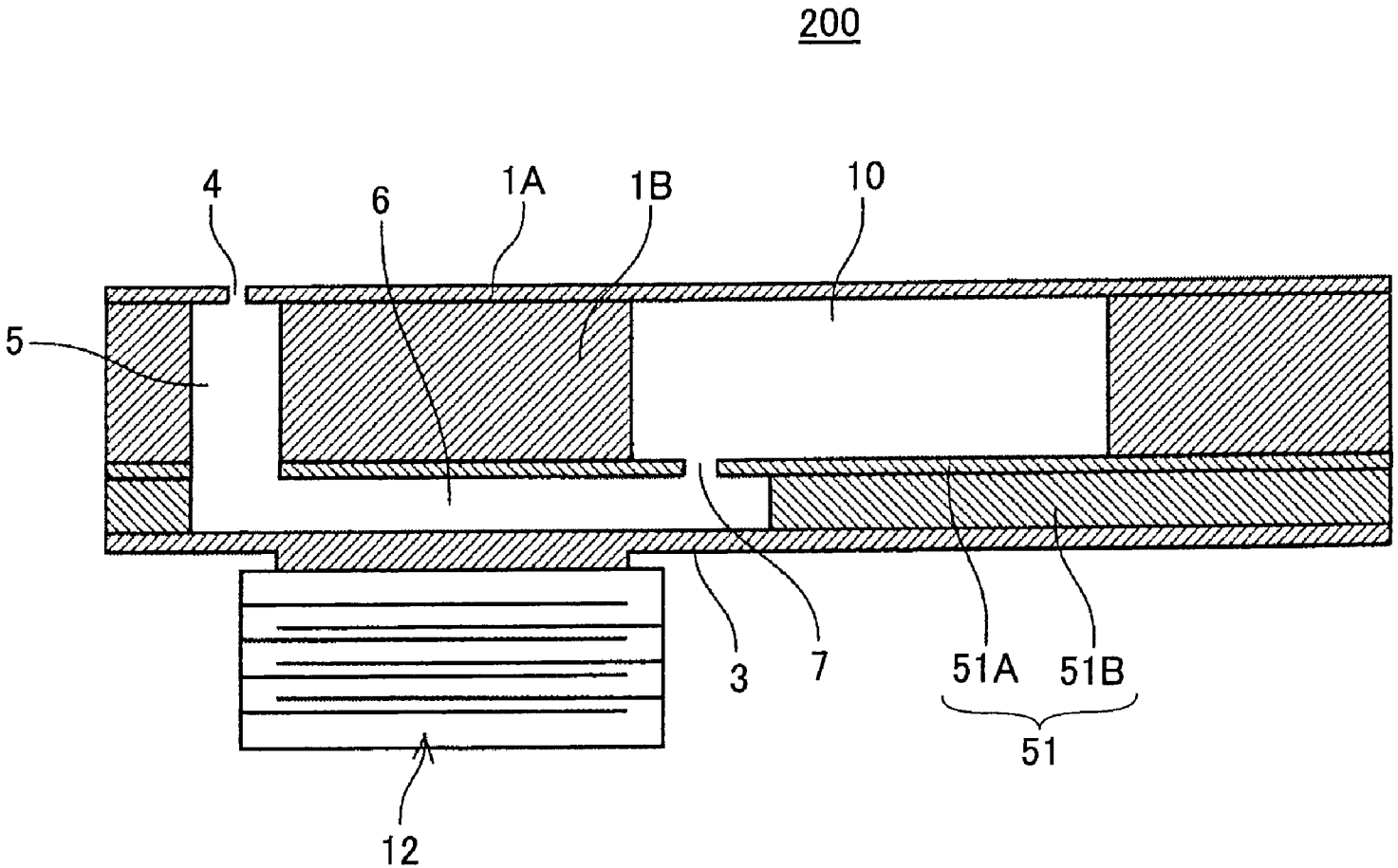
FIG. 5 is a cross-sectional view of a liquid jet head with respect to a longitudinal direction of a liquid chamber according to another embodiment of the present invention.

Next, a liquid jet head 200 according to a second embodiment of the present invention is described with reference to FIG. 5. FIG. 5 is a cross-sectional view of a liquid jet head with respect to a longitudinal direction of a liquid chamber according to the second embodiment of the present invention.

The liquid jet head 200 includes a nozzle/flow path plate 1, a fluid resistance flow path plate (fluid resistance member) 51, and a vibration plate 3. The nozzle/flow path plate 1 has a nozzle member portion 1A and a flow path member portion 1B that are integrally formed. The fluid resistance member 51 has a fluid resistance portion 51A and a flow path member portion 51B that are integrally formed. The vibration plate 3 is bonded to a bottom surface of the fluid resistance member 51.

A nozzle 4 is formed in the nozzle member portion 1A of the nozzle/flow path plate 1. A nozzle communication path 5 is formed in the flow path member portion 1B. Furthermore, a penetrated part is formed in the flow path member portion 1Ba (one end is sealed (closed) by the nozzle member portion 1A). The penetrated part serves as a common liquid chamber (common flow path) 10. It is to be noted that, although the nozzle member portion 1A and the flow path member portion 1B are integrally formed according to this embodiment of the present invention, the nozzle member portion 1A and the flow path member portion 1B may be formed as separate independent members.

A penetration hole is formed in the fluid resistance portion 51A of the fluid resistance member 51. The penetration hole is formed extending from a common liquid chamber 10 to a liquid chamber 6 for allowing liquid to be supplied therethrough (supply port). The penetration hole serves as a fluid resistance part 7 having greater fluid resistance than that of the liquid chamber 6. Furthermore, another penetrated part is formed in the flow path member portion 51B of the fluid resistance member 51. The other penetrated part serves as the liquid chamber 6. In the above-described embodiment of the liquid jet head 200, the flow path member 1B of the nozzle/flow path plate 1 and the flow path member portion 51B of the fluid resistance member 51 form a flow path part of the liquid jet head 200.

By performing the electroforming method described in the first embodiment of the present invention in forming the fluid resistance member 51, each of the fluid resistance portion 51A and the flow path member portion 51B can be formed with a metal material having substantially the same composition where the crystal particles of the metal material of the fluid resistance portion 51A have an average particle diameter which is smaller than that of the crystal particles of the metal material of the flow path member portion 51B.

Accordingly, the fluid resistance portion 51A and the flow path member portion 51B can be integrally formed while attaining a high rigidity for the fluid resistance portion 51A having a significant influence on liquid jetting efficiency and liquid jetting characteristics of the liquid jet head. Hence, liquid jetting efficiency can be improved and steady liquid jetting characteristics can be attained.

It is to be noted that, although the above-described embodiment of the present invention has the fluid resistance part 7 extending from a common liquid chamber 10 to a liquid chamber 6, a filter part, for example, may also be provided for capturing foreign materials between the common liquid chamber (common flow path) 10 and the liquid chamber (individual flow path) 6. Thus, the members for forming the filter part (filter members) may be integrally formed with the members forming the flow path part (flow path members) by using the above-described electroforming method. Accordingly, each of the filter members and the flow path members can be formed with a metal material having substantially the same composition where the crystal particles of the metal material of the filter members have an average particle diameter which is smaller than that of the crystal particles of the metal material of the flow path members. Thereby, the filter members and the flow path members can be integrally formed while attaining a high rigidity for the filter members for satisfactorily capturing foreign materials. In addition, liquid jetting efficiency can be improved and steady liquid jetting characteristics can be attained.

The above-described electroforming method according to an embodiment of the present invention may also be used for integrally forming a vibration plate member (e.g., vibration plate 3) and a flow path member. Thereby, each of the vibration plate member and the flow path member can be formed with a metal material having substantially the same composition where the crystal particles of the metal material of the vibration plate member has an average particle diameter which is smaller than that of the crystal particles of the metal material of the flow path member. Thereby, the vibration plate member and the flow path member can be integrally formed while attaining a high rigidity for the vibration plate member for attaining a desired vibration characteristic. In addition, liquid jetting efficiency can be improved and steady liquid jetting characteristics can be attained.

The above-described electroforming method according to an embodiment of the present invention may also be used for integrally forming a flow path member and a thin layer member 1A having less thickness than the flow path member. Thereby, each of the flow path member and the thin layer member 1A can be formed with a metal material having substantially the same composition where the crystal particles of the metal material of the thin layer member 1A has an average particle diameter which is smaller than that of the crystal particles of the metal material of the flow path member. Thereby, the thin layer member 1A and the flow path member can be integrally formed while attaining a high rigidity for the thin layer member 1A. In addition, liquid jetting efficiency can be improved and steady liquid jetting characteristics can be attained.

In the above-described embodiment of the present invention, a piezoelectric actuator using a piezoelectric element is provided as a pressure generating part of the liquid jet head. However, the pressure generating part is not limited to the piezoelectric actuator. For example, a thermal actuator that manipulates phase change of film boiling of a liquid by using an electrothermal converting element (e.g., heat element), a shape memory alloy actuator that manipulates phase change of metal caused by temperature change, or an electrostatic actuator that manipulates electrostatic force may be used as pressure generating part for generating pressure for jetting droplets of liquid.

Figure 6:
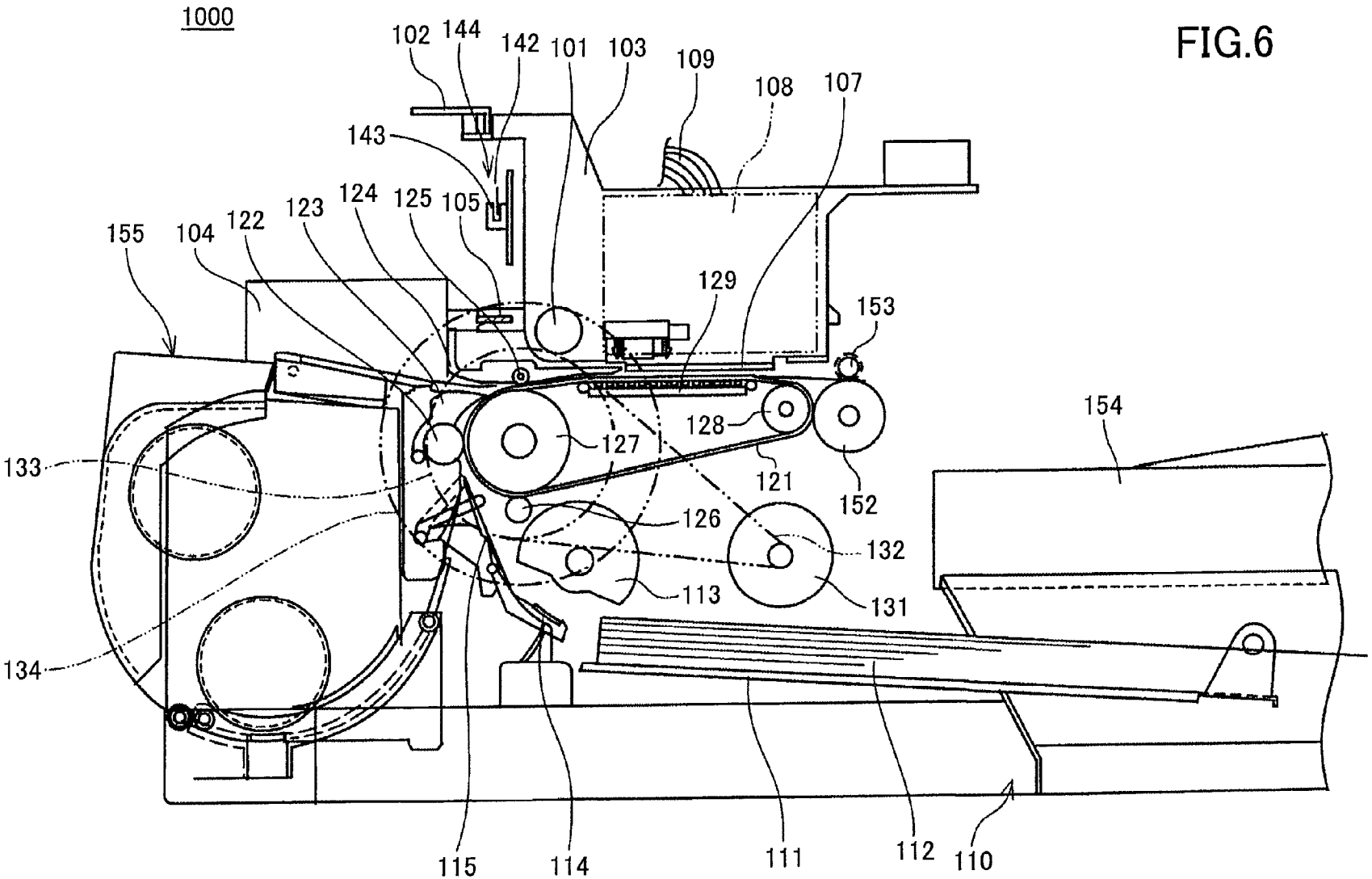
FIG. 6 is a side view for describing an overall configuration of an exemplary image forming apparatus according to an embodiment of the present invention.
Figure 7:
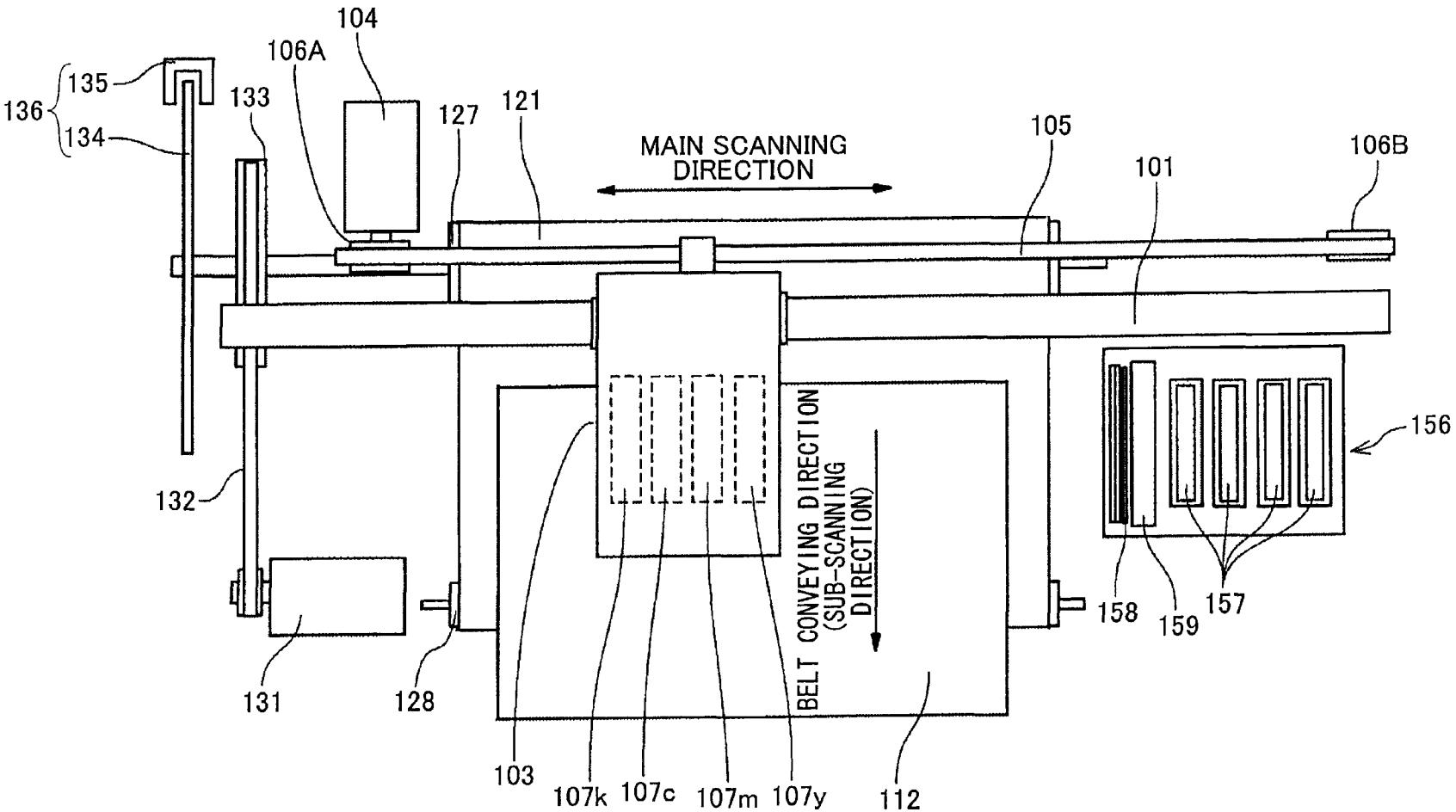
FIG. 7 is a plane view showing a part of the image forming apparatus shown in FIG. 6 according to an embodiment of the present invention.

Next, an image forming apparatus 1000 having a liquid jet head according to an embodiment of the present invention is described with reference to FIGS. 6 and 7. FIG. 6 is a side view for describing an overall configuration of an exemplary image forming apparatus according to an embodiment of the present invention. FIG. 7 is a plane view showing a part of the image forming apparatus shown in FIG. 6 according to an embodiment of the present invention.

The image forming apparatus 1000 has a carriage 103 which is held by a guiding rod 101 and a guide rail 102 in a slidable manner in a main-scanning direction. The carriage 103 is moved in the arrow direction shown in FIG. 7 by a main-scanning motor 104 via a timing belt 105 wound across a driving pulley 106A and a driven pulley 106B.

The carriage 103 according to an embodiment of the present invention is mounted with a recording head 107 including four liquid jetting heads 107*k*, 107*c*, 107*m*, and 107*y* for jetting droplets (ink droplets) of recording liquids of black (K), cyan (C), magenta (M), and yellow (Y). The liquid jetting heads 107*k*, 107*c*, 107*m*, and 107*y* are aligned in a main scanning direction and positioned facing downward in a liquid jetting direction. Although the recording head 107 has separate liquid jetting heads, the recording head may have one or more liquid jetting heads having plural rows of nozzles for jetting droplets of recording liquid of each color. Furthermore, the number of colors or the order of arranging the liquid jetting heads is not to be limited to those of the foregoing recording head 107.

The carriage 103 is also mounted with sub-tanks 108 for supplying recording liquid (ink) of each color to the recording head 107. The sub-tanks 108 supply the ink to a main tank (ink cartridge, not shown) via ink supplying tubes 109.

The image forming apparatus 1000 according to an embodiment of the present invention has a sheet feeding part including, for example, a sheet feed cassette 110 for feeding a recording medium (paper) 112 stacked on a paper stacking part (platen) 111. The image forming apparatus 1000 also has a sheet feeding roller 113 and a separating pad 114 having a high friction coefficient for separating each sheet of paper 112 from the stack of paper on the paper stacking part 111 and feeding the separated sheet of paper 112. The separating pad 114, which faces the sheet feeding roller 113, is urged toward the direction of the sheet feeding roller 113.

The image forming apparatus 1000 according to an embodiment of the present invention also has a conveying part for conveying the paper 112 fed from the sheet feeding part to a part below the recording head 107. For example, the conveying part includes: a conveyor belt 121 for conveying the paper 112 by electrostatic attraction; a counter-roller 122 for conveying the paper 112 by sandwiching the paper 112 (conveyed via a guide 115) between the conveyor belt 121; a conveying guide for changing the orientation of the substantially vertically conveyed paper 112 to an angle of approximately 90 degrees and placing the paper on the conveyor belt 121; and a tip pressing roller 125 urged in the conveyor belt direction 121 by a pressing member 124. The image forming apparatus 1000 also has a charging part including a charging roller 126 for charging the surface of the conveyor belt 121.

The conveyor belt 121 according to an embodiment of the present invention is an endless belt which is wound across a conveyor roller 127 and a tension roller 128. A sub-scan motor 131 rotates the conveyor roller 127 via a timing belt 132 and a timing roller 133. By rotating the conveyor roller 127, the conveyor belt 121 is rotated in a belt conveying direction (sub-scanning direction). It is to be noted that a guiding member 129 is provided on the back side of the conveyor belt 121 in correspondence with the area where an image is formed by the recording head 107.

A slit disk 134 is attached to an axle of the conveyor roller 127. The slit disk 134 has attached a sensor 135 for detecting a slit of the slit disk 134. The slit disk 134 and the sensor 135 form an encoder 136.

The charging roller 126, contacting the surface of the conveyor belt 121, is arranged to subordinately rotate according to the rotation of the conveyor belt 121. A pressing force of 2.5 N is applied to each end of the axle of the charging roller 126.

The front side of the carriage 103 is provided with an encoder scale 142 having a slit(s). Furthermore, the front face side of the carriage 103 is provided with an encoder sensor 143 including a transmission type sensor for detecting the slit(s) of the encoder scale 142. The encoder scale 142 and the encoder sensor 143 form another encoder 144 for detecting the position of the carriage 103 in the main scanning direction.

Furthermore, the image forming apparatus 1000 according to an embodiment of the present invention has a sheet discharge part for discharging the paper 112 on which an image is formed (recorded) by the recording head 107. The sheet discharge part includes, for example, a separating portion for separating the paper from the conveyor belt 121, sheet discharge rollers 152, 153, and a sheet discharge tray 154 for piling the discharged paper 112 thereon.

The image forming apparatus 1000 according to an embodiment of the present invention has a double-side sheet feeding unit 155 detachably attached to its rear side. The double-side sheet feeding unit 155 is for receiving a sheet of paper 112 returned by reverse rotation of the conveyor belt 121, flipping the paper 112 upside down, and feeding the paper 112 back to an area between the counter roller 122 and the conveyor belt 121.

A maintenance/recovery mechanism 156 is provided on a non-printing area on one side of the main scanning direction of the carriage 103. The maintenance/recovery mechanism 156 is for maintaining (preserving) and recovering the state of the nozzles of the recording head 107. The maintenance/recovery mechanism 156 includes, for example, plural caps for capping the corresponding the nozzles of the recording head 107, a wiper blade (blade member) 158 for wiping off recording liquid from the faces of the nozzles, and a blank jet receiver 159 for receiving recording liquid in an operation for jetting undesired accumulated recording liquid.

In the above-described image forming apparatus 1000 according to an embodiment of the present invention, a sheet of paper 112 is separated and fed from the sheet feeding part. Then, the paper 112 is conveyed in an upward vertical direction and is guided by the guide 115. Then, the paper 112 is conveyed in a manner sandwiched between the conveyor belt 121 and the counter roller 122. Then, the tip of the paper 112 is guided by the conveyor guide 123 and pressed against the conveyor belt 121 by the tip pressing roller 125, so that the orientation of the paper is changed approximately 90 degrees.

Then, positive and negative voltages (alternate voltage) are repetitively alternately is applied to the charging roller 126 from an AC bias supplying part (high voltage source) by a control circuit (not shown), so that the conveyor belt 121 can be charged in the belt conveying direction (sub-scanning direction) according to an alternating voltage pattern. That is, the conveyor belt 121 has positive and negative charges alternatively formed in a manner covering a predetermined width of the conveyor belt 121 in a belt-like manner. By conveying the paper 112 onto the alternately charged conveyor belt 121, the paper 112 is electrostatically attracted to the conveyor belt 121 and conveyed in the sub-scanning direction by the rotation of the conveyor belt 121.

Then, a single line is recorded by moving the carriage 103 back and forth and driving the recording head 107 according to an image signal, so that ink droplets can be jetted on the paper 112 being statically placed on the conveyor belt 121. After recording the single line, the paper 112 is conveyed a predetermined amount for recording the next line. The recording process is completed upon receiving a recording completion signal or a signal indicating detection of the rear end of the paper 112. Then, the paper 112 is discharged to the sheet discharge tray 154.

In a case of double-side printing, the conveyor belt 121 is rotated in reverse after recording on the front side (first side) of the paper 112. By the reverse rotation of the conveyor belt 121, the paper 112 is delivered to the double-side sheet feeding unit 155. Then, the paper 112 is flipped upside down so that the back side of the paper 112 can be recorded. Then, the paper 112 is returned to the area between the counter roller 122 and the conveyor belt 121. Based on a controlled timing, the sheet 112 is conveyed onto the conveyor belt 121 to have its back side recorded. Then, the recorded paper 112 is discharged to the sheet discharge tray 154.

In a case where the image forming apparatus 1000 is standing by for recording (standby state), the carriage 103 is moved toward the maintenance/recovery mechanism 155 so that the surfaces of the nozzles of the recording head 107 can be capped by the corresponding caps 157. By maintaining the nozzles in a wet state, defective jetting performance due to dry ink can be prevented. Furthermore, in a state where the nozzles of the recording head 107 are capped by the caps 157, recording liquid is absorbed from the nozzles and a recovery process for removing accumulated recording liquid and bubbles is conducted. In the recovery process, the wiper blade 158 wipes off the ink adhered to the surfaces of the nozzles of the recording head 107. Furthermore, a blank jetting operation is conducted for jetting ink unnecessary for recording. The blank jetting operation may be conducted before the recording process or during the recording process. Thereby a steady jetting performance by the recording head 107 can be maintained.

With the image forming apparatus 1000 according to an embodiment of the present invention, high jetting efficiency can be achieved and steady jetting characteristics can be attained. Hence, the image forming apparatus 1000 can form images in high quality.

Although the above-described liquid jet head according to an embodiment of the present invention is explained by applying it to an image forming apparatus having a configuration of a printer, the liquid jet head may also be applied to other image forming apparatuses. For example, the liquid jet head according to an embodiment of the present invention may be applied to a multi-function machine having the functions of a printer, a facsimile, and a copier. Furthermore, the liquid jet head according to an embodiment of the present invention may be applied to an image forming apparatus using a liquid other than ink (recording liquid). For example, the liquid jet head according to an embodiment of the present invention may be applied to an image forming apparatus using a fixing process liquid.

Further, the present invention is not limited to these embodiments, but variations and modifications may be made without departing from the scope of the present invention.

The present application is based on Japanese Priority Application Nos. 2007-031146 and 2007-279722 filed on Feb. 9, 2007, and Oct. 27, 2007, with the Japanese Patent Office, the entire contents of which are hereby incorporated by reference.

The invention claimed is:

1. A liquid jet head comprising:

a nozzle member having a plurality of nozzles for jetting a liquid therefrom;

a flow path member forming at least a part of a liquid chamber communicating with each of the plural nozzles; and a pressure generating part for generating pressure that is applied to the liquid inside the liquid chamber;

wherein the nozzle member and the flow path member are each formed by a metal material;

wherein the metal material of the nozzle member has substantially the same composition as the metal material of the flow path member;

wherein the metal material of the nozzle member includes crystal particles having an average particle diameter which is less than that of the crystal particles included in the metal material of the flow path member;

wherein the nozzle member and the flow path member are integrally formed; and wherein the flow path member has a portion positioned toward an interface with the nozzle member, and the portion includes crystal particles having an average particle diameter which is substantially the same as that of the crystal particles of the nozzle member.

2. The liquid jet head as claimed in claim 1, wherein the nozzle member and the flow path member are formed by electrodeposition.

3. The liquid jet head as claimed in claim 1, wherein the portion of the flow path member is situated in an area within 0.1 μm to 5 μm of the interface with the nozzle member.

4. The liquid jet head as claimed in claim 1, wherein the flow path member has a portion positioned toward the interface with the nozzle member, wherein the portion includes crystal particles having an average particle diameter that increases the farther away are the crystal particles from the interface with the nozzle member.

5. The liquid jet head as claimed in claim 1, wherein the metal material is nickel.

6. The liquid jet head as claimed in claim 5, wherein the nickel has an X-ray diffraction spectrum having diffraction peaks at least in a Ni (111) plane and a Ni (200).

7. The liquid jet head as claimed in claim 6, wherein the nozzle member and the flow path member are configured to exhibit a peak intensity ratio satisfying a relationship of "$I_a$ (111) /$I_a$ (200) <$I_b$ (111) / $I_a$ (200)";

wherein "$I_a$ (111)" indicates a diffraction peak intensity of the (111) plane of the nozzle member, "$I_a$ (200)" indicates a diffraction peak intensity of the (200) plane of the nozzle member, "$I_b$ (111)" indicates a diffraction peak intensity of the (111) plane of the flow path member, and "$I_b$ (200)" indicates a diffraction peak intensity of the (200) plane of the flow path member.

8. The liquid jet head as claimed in claim 1, further comprising: a water-repellent layer formed on a liquid jetting side of the nozzle member.

9. An image forming apparatus comprising: the liquid jet head as claimed in claim 1.

10. A liquid jet head comprising:

a nozzle member having a plurality of nozzles for jetting a liquid therefrom;

a flow path member forming at least a part of a plurality of liquid chambers communicating to each of the plural nozzles;

a common flow path for supplying the liquid to each of the liquid chambers;

a fluid resistance member forming a plurality of fluid resistance parts between the common flow path and each liquid chamber; and a pressure generating part for generating pressure that is applied to the liquid inside the liquid chamber;

wherein the fluid resistance member and the flow path member are each formed by a metal material;

wherein the metal material of the fluid resistance member has substantially the same composition as the metal material of the flow path member;

wherein the metal material of the fluid resistance member includes crystal particles having an average particle diameter which is less than that of the crystal particles included in the metal material of the flow path member;

wherein the fluid resistance member and the flow path member are integrally formed; and wherein the flow path member has a portion positioned toward an interface with the fluid resistance member, wherein the portion includes crystal particles having an average particle diameter which is substantially the same as that of the crystal particles of the fluid resistance member.

11. A liquid jet head comprising:

a liquid chamber communicating to a plurality of nozzles for jetting a liquid therefrom;

a flow path member forming at least a part of the liquid chamber;

a pressure generating part for generating pressure that is applied to the liquid inside the liquid chamber; and a thin layer member integrally formed with the flow path member; wherein the thin layer member is thinner than the flow path member;

wherein the thin layer member and the flow path member are each formed by a metal material;

wherein the metal material of the thin layer member has substantially the same composition as the metal material of the flow path member;

wherein the metal material of the thin layer member includes crystal particles having an average particle diameter which is less than that of the crystal particles included in the metal material of the flow path member;

wherein the thin layer member and the flow path member are integrally formed; and wherein the flow path member has a portion positioned toward an interface with the thin layer member, wherein the portion includes crystal particles having an average particle diameter which is substantially the same as that of the crystal particles of the thin layer member.

* * * * *